United States Patent [19]

Avni et al.

[11] Patent Number: 4,670,921

[45] Date of Patent: Jun. 9, 1987

[54] PORTABLE STRETCHER WHICH IS COLLAPSIBLE INTO A COMPACT PACKAGE

[75] Inventors: Yoav Avni, Philadelphia, Pa.; Ervin Leshner, Cherry Hill, N.J.

[73] Assignee: Action Manufacturing Company, Philadelphia, Pa.

[21] Appl. No.: 618,511

[22] Filed: Jun. 8, 1984

[51] Int. Cl.[4] ..... A47G 1/00; A47G 1/04

[52] U.S. Cl. ..... 5/82 R; 5/116; 5/313 R; 16/326; 16/327; 16/352; 16/366

[58] Field of Search ..... 5/82 R, 114, 116, 117, 5/111, 313 R, 313 B; 16/326, 327, 332, 349, 352, 341, 366

[56] References Cited

U.S. PATENT DOCUMENTS

| | | | |
|---|---|---|---|
| 273,306 | 3/1983 | Powers | 5/116 |
| 709,332 | 9/1902 | Koons | 5/82 |
| 2,650,373 | 9/1953 | Zeller et al. | 5/82 R |
| 2,675,564 | 4/1954 | Hughes | 5/82 |
| 2,761,153 | 9/1956 | Mew | 5/82 |
| 3,264,659 | 8/1966 | Magni et al. | 5/82 |
| 3,555,578 | 1/1971 | Pile | 5/82 R |
| 3,797,051 | 3/1974 | Evans | 16/327 |
| 3,886,606 | 6/1975 | Bradford | 5/82 |

FOREIGN PATENT DOCUMENTS

| | | | |
|---|---|---|---|
| 707578 | 4/1931 | France | 5/82 |
| 909355 | 12/1950 | France | 5/82 |
| 1173662 | 2/1959 | France | 5/82 R |
| 2447717 | 10/1980 | France | 5/82 R |
| 453278 | 9/1936 | United Kingdom | 5/114 |
| 1031527 | 6/1966 | United Kingdom | 5/82 |

*Primary Examiner*—Alexander Grosz

*Attorney, Agent, or Firm*—Woodcock Washburn Kurtz Mackiewicz & Norris

[57] ABSTRACT

A portable, collapsible stretcher has frame poles, each of which have a medial joint which folds in one direction and two outer joints which fold in the opposite direction. A wedge is insertable into the medial joint to support the weight when the stretcher is extended. The outer joints have a locking mechanism which is operated by a linkage interconnecting the spreader bars and the folding legs. As the stretcher is extended, the outer joints are locked and the legs are unfolded from their normal position against the frame poles.

17 Claims, 13 Drawing Figures

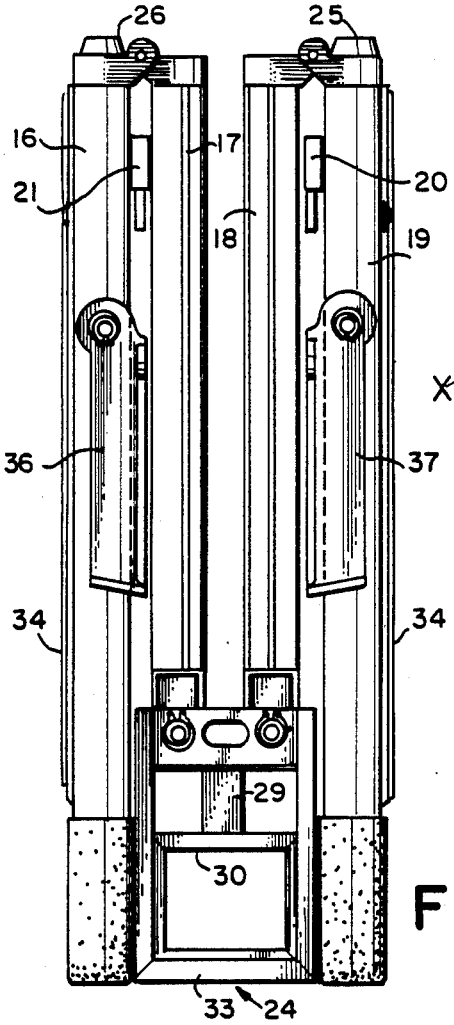
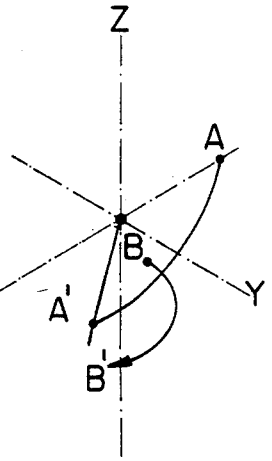
FIG. 13
FIG. 11
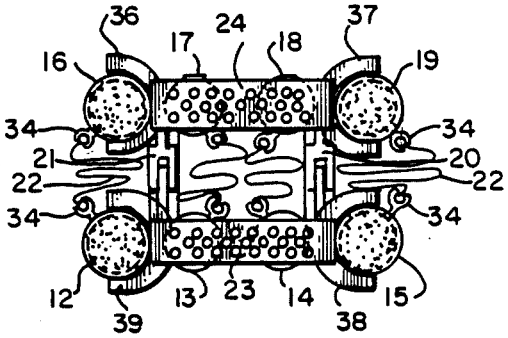
FIG. 12

PORTABLE STRETCHER WHICH IS COLLAPSIBLE INTO A COMPACT PACKAGE

BACKGROUND OF THE INVENTION

This invention relates to portable stretchers, and more particularly, to a stretcher which can be collapsed into a compact, easily carried, size.

Litters, or stretchers, for field use must be strong and durable for carrying injured persons over rough terrain for long distances. However, when not in such use, these stretchers must be foldable to a compact, easily transportable package, as a back pack, for example. Until now, collapsible stretchers have been cumbersome and somewhat difficult to move about. There is a pressing need in the military and medical field for an all-purpose stretcher which is light, quickly assembled and disassembled, compact in the collapsed state and therefore easy to handle by soldiers and medics.

Many prior art stretchers have frame poles with joints so that the stretcher can be folded. To our knowledge, no prior art stretchers are capable of being folded to such a compact size that it can be easily carried, on the back, for instance, and yet still be sufficiently rigid to bear weight when it is in use.

In such stretchers, the joint for a member which folds in the opposite direction of weight-bearing is a particular problem. The lack of a reliable joint of this type has impeded the use of stretchers which can be folded in both directions into a compact package.

Examples of attempts to solve this problem are shown in U.S. Pat. Nos. 3,555,578 - Pile, and 2,650,373 - Zeller, et al. Pile's frame poles have two hinges 11 separated by a support 10, two inner members 12 which fold in the direction of load-bearing and two outer members 14 which fold in the direction opposite to weight-bearing. When the Pile stretcher is extended, cables support the joints against collapsing in the weight-bearing direction. Cables stretch and do not provide the rigidity required in a stretcher. In addition, the central cable support member 10 in Pile prevents folding of the stretcher to a compact size. In Zeller, et al the middle sections 13, 14 and end section 15–16 all fold in the direction of weight bearing. The members 18, 19, and 20 span the folding sections of the pole frames and prevent folding them to a compact size.

It is an object of the present invention to provide a stretcher which folds to a compact size and which can be extended easily into a rigid, load-supporting flat bed surface.

It is another object of the invention to provide a stretcher in which the locking mechanism for the joint is easily actuated when the stretcher is folded or unfolded.

SUMMARY OF THE INVENTION

In accordance with the present invention, the frame poles of a collapsible stretcher have a medial joint which is hinged so that adjacent members fold opposite to the weight-bearing direction, and a wedge which is insertable into the joint when the frame pole is extended so that the joint supports weight. A spring biases the wedge toward insertion into the joint when the frame pole is extended. The wedge is mounted on a frame which travels within a U-shaped leg member. The spring is between the leg member and the frame to urge the wedge toward insertion into the joint.

In accordance with another aspect of the present invention, folding legs on both ends of each frame pole cooperate with the leg member to form a support for the stretcher.

The collapsible outer joints on each side of the medial joint are hinged to fold in the direction opposite to the medial joint so that the frame poles and spreader bars can be collapsed into a compact package.

Further in accordance with the invention, each frame pole has a closed channel, having a longitudinal opening for receiving a bead on the support sheet to secure the support sheet to the frame poles.

In accordance with another aspect of the invention, spreader bars, folding legs, and locking mechanisms for the outer joints, are interconnected by a linkage such that when the spreader bars are extended, the folding legs are positioned and the outer joints are locked. This facilitates easy unfolding of the stretcher so that it can quickly be put into condition for use for the outer joints. The locking mechanism for the outer joint includes a tube inside of one of the tubular members which makes up the frame poles. This tube is movable to span the tubular members on both sides of the outer hinges to provide a rigid hinge when the stretcher is extended.

The frame poles of the present invention are extruded tubular members making the entire stretcher extremely light in weight. It can be folded to an extremely small size, for example with external dimensions of $24\frac{1}{2}'' \times 8'' \times 5\frac{1}{2}''$. When it is extended, it provides a rigid flat bed surface of adequate size, for example, $76'' \times 20''$.

The foregoing and other objects, features and advantages of the invention will be better understood from the following more detailed description and appended claims.

SHORT DESCRIPTION OF THE DRAWINGS

FIG. 11 is a side elevational view of the folded stretcher; and

FIG. 12 is a top plan view of the folded stretcher.

FIG. 13 shows the two planes in which points on the link interconnecting the legs and the spreader bar move.

DESCRIPTION OF THE PREFERRED EMBODIMENT

Figure 1:
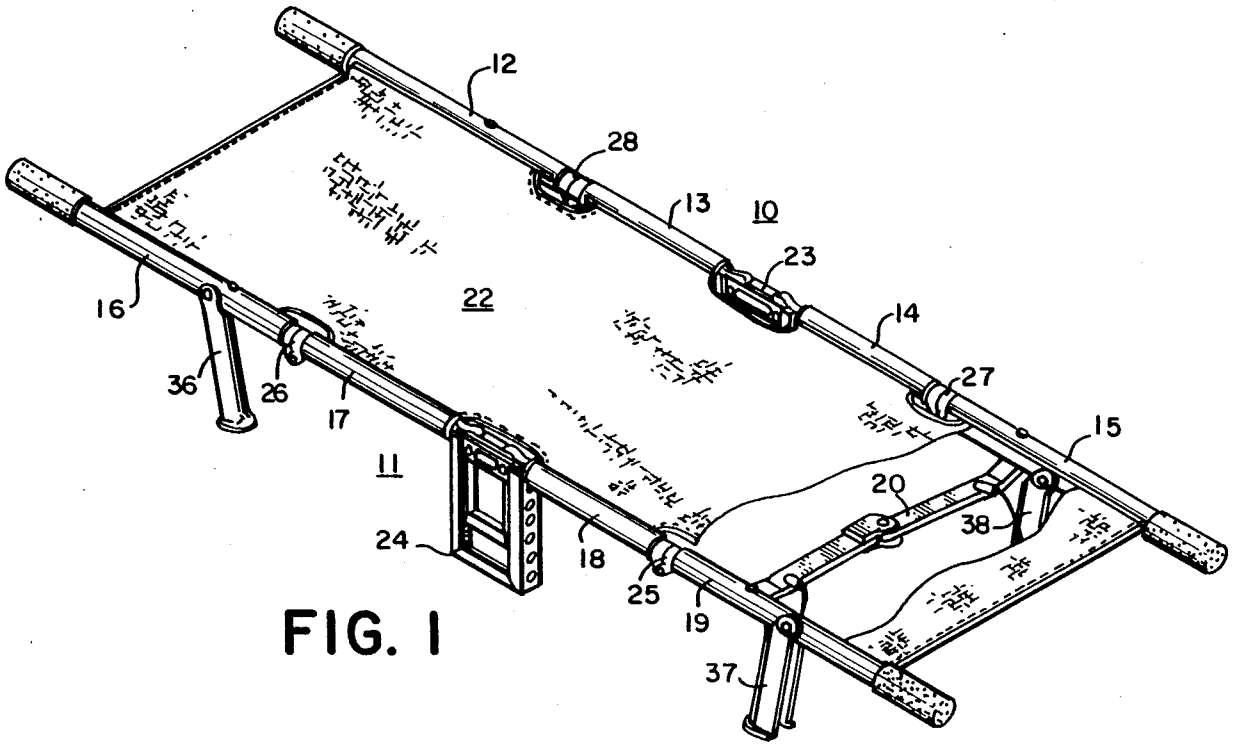
FIG. 1 is a perspective view of the stretcher of the present invention.
Figure 7:
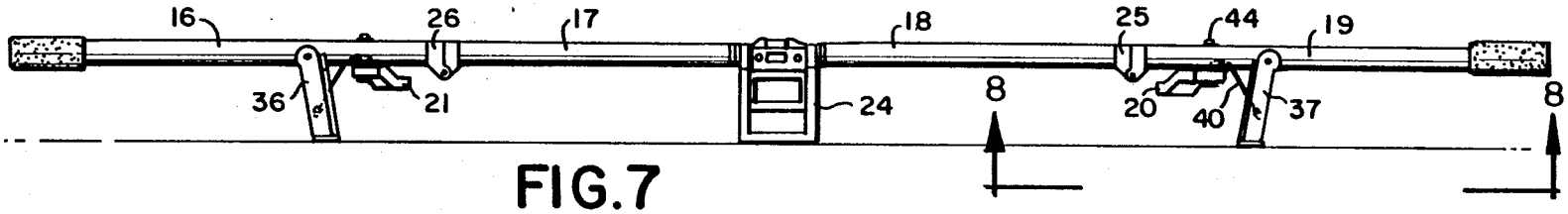
FIG. 7 is a side elevational view of the stretcher in its extended position.
Figure 8:
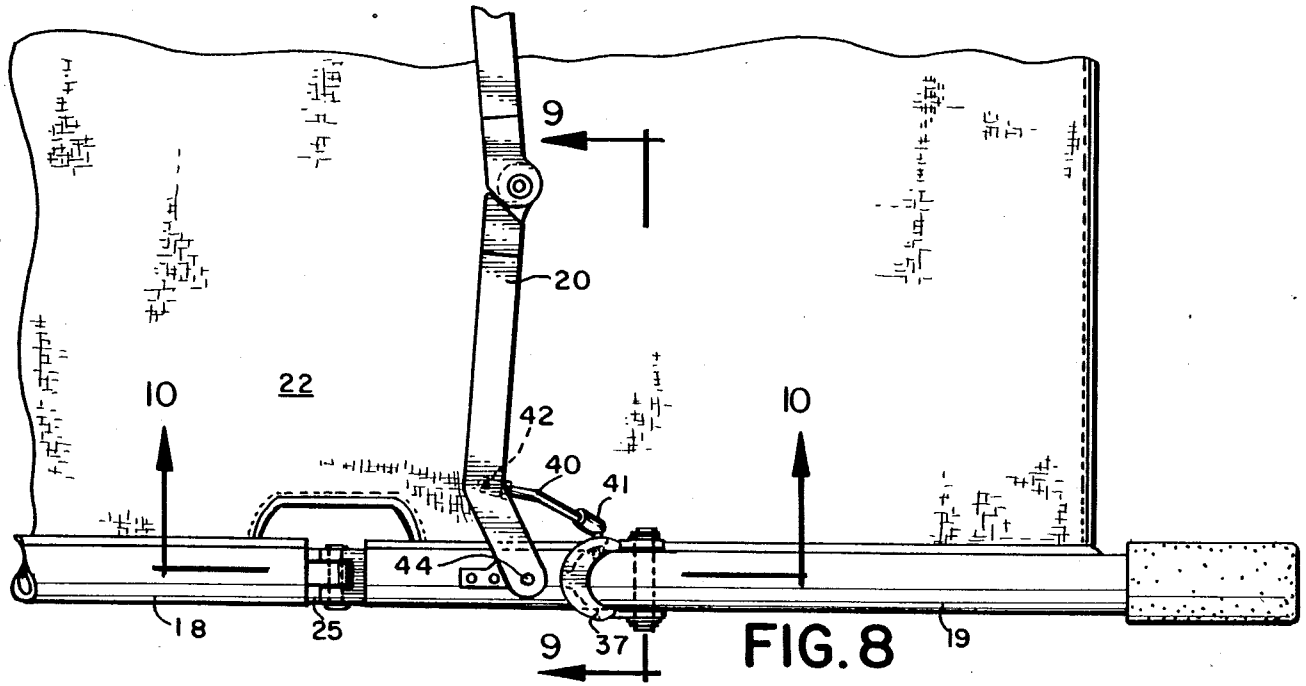
FIG. 8 is a view on the line 8—8 of FIG. 7.

Referring to FIG. 1, the collapsible, portable stretcher of the present invention includes a pair of extendible frame poles 10 and 11. Frame pole 10 includes extruded aluminum tubular members 12–15 and frame pole 11 includes tubular members 16–19. Spreader bars 20 and 21 (FIG. 7) rigidly interconnect the frame poles when the spreader bars are extended.

A flexible support sheet 22 is secured to the frame poles and suspended from the poles when they are extended to form a weight-bearing platform.

Frame pole 10 has a medial joint 23 and frame pole 11 has a medial joint 24 each hinged so that adjacent tubular members 13, 14, 17 and 18 fold in the direction opposite to weight-bearing. Outer joints 25–28 on the frame poles fold in the direction opposite to the medial joint so that frame poles and spreader bars can be collapsed into a compact package.

Figure 2:
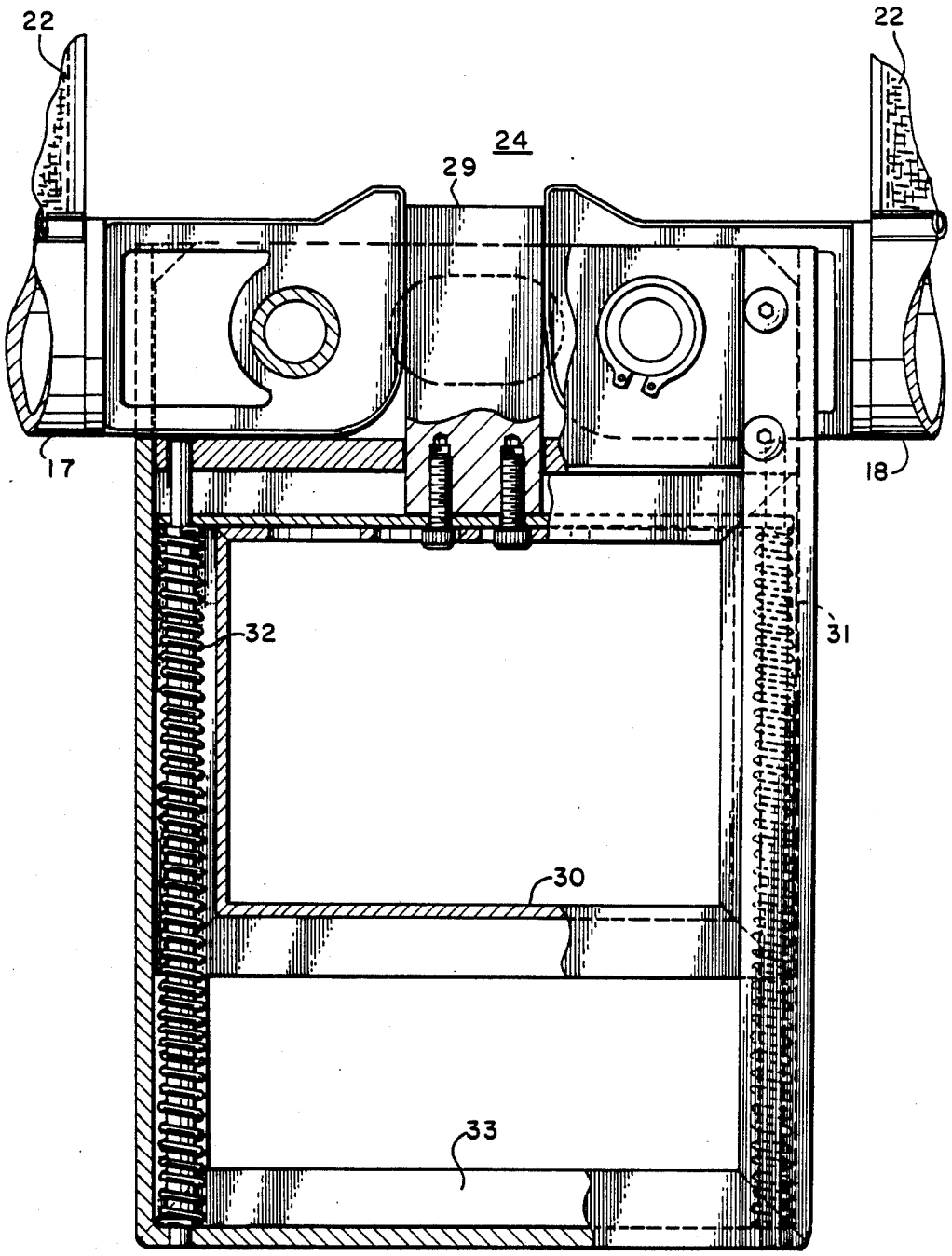
FIG. 2 shows the middle leg, carrying handle, and wedge which is inserted into the medial joint.
Figure 3:
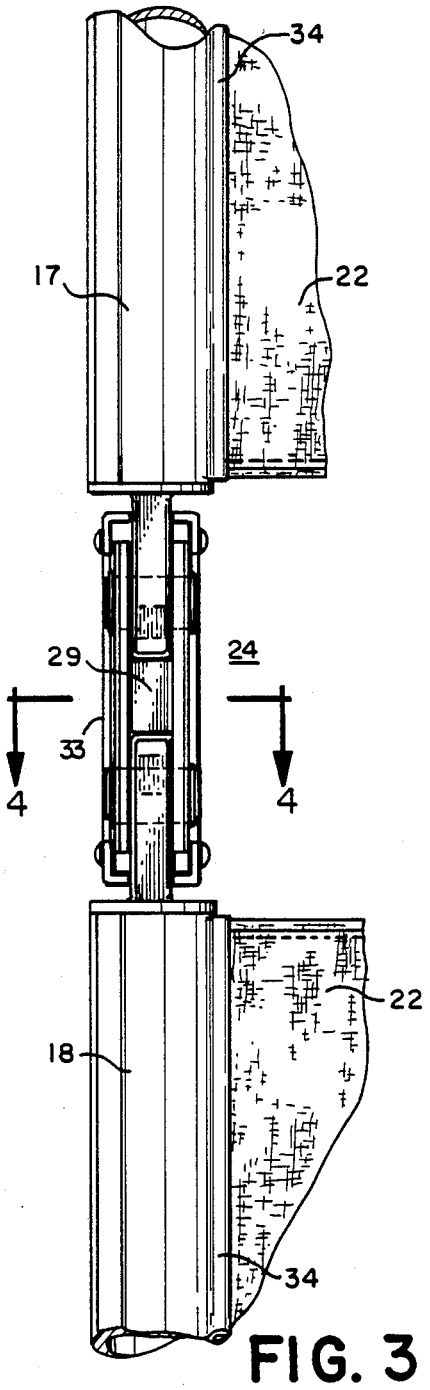
FIG. 3 is a top view of the medial joint.
Figure 4:
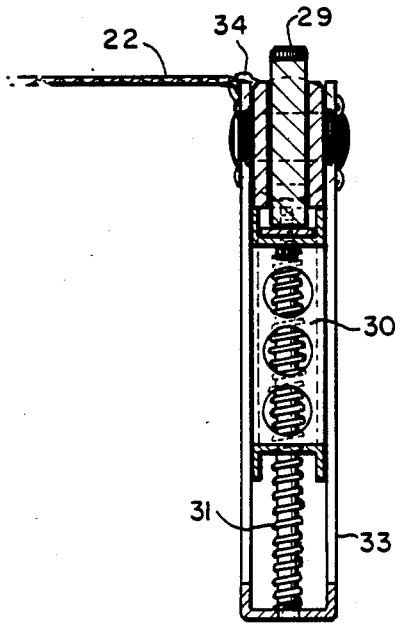
FIG. 4 is a sectional view of the line 4—4 of FIG. 3.
Figure 6:
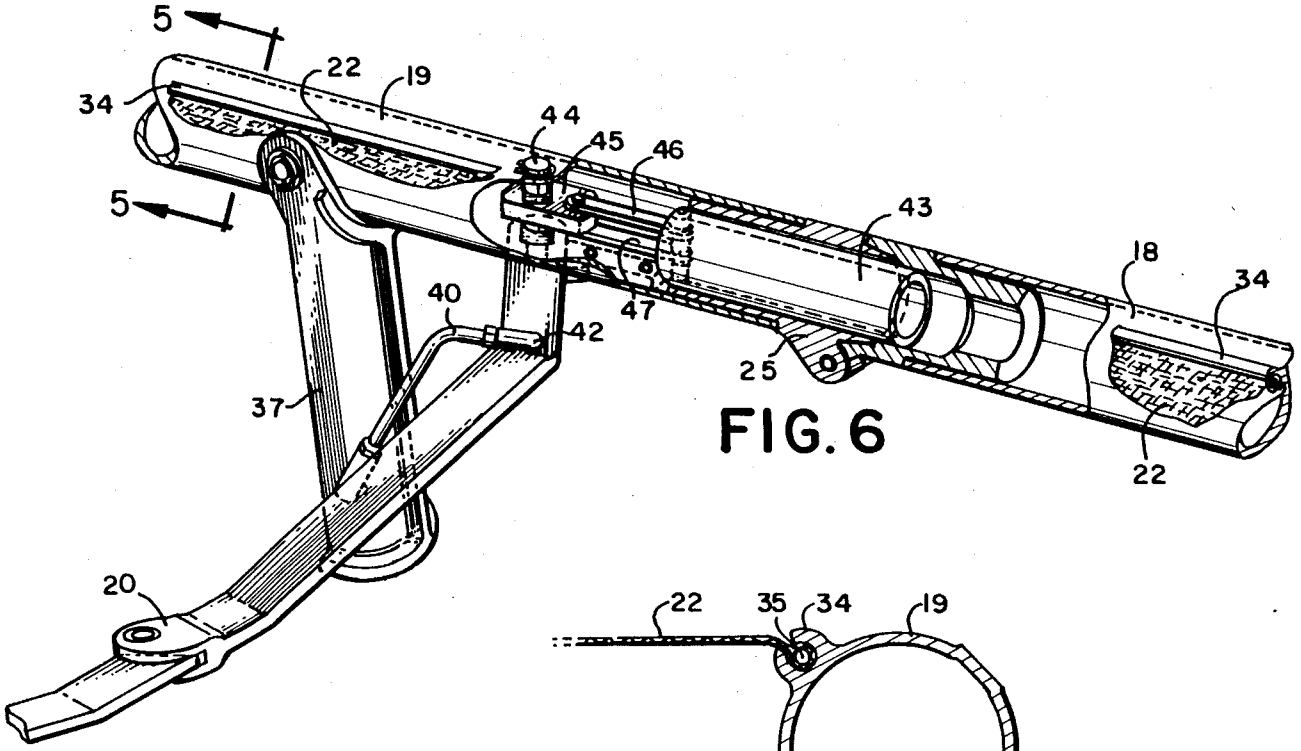
FIG. 6 is a perspective view partly in section, showing the spreader bar, folding leg, and joint locking mechanism and the linkage interconnecting them.

As best shown in FIGS. 2–4, a wedge 29 is insertable into the medial joint when the pole is extended so that the hinge supports the weight when the stretcher is in use. Springs 31 and 32 bias the wedge toward insertion into the joint when the frame pole is extended. Wedge 29 is mounted on a frame 30 which travels within a U-shaped leg member 33. Springs 31 and 32 are between leg member 33 and frame 30 to urge the wedge into insertion into the medial joint.

Figure 5:
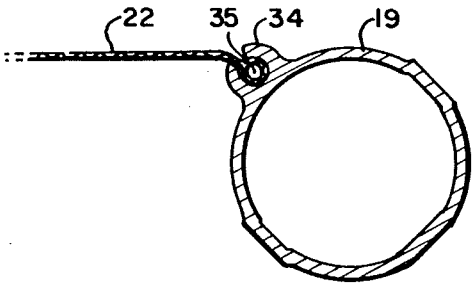
FIG. 5 is a sectional view through a tubular member of a frame pole, and more particularly, is a section on the line 5—5 of FIG. 6.

As best shown in FIG. 5, the tubular members 12–19 have a longitudinal closed channel 34 having an opening for receiving a bead 35 on the support sheet 22. This secures the support sheet to the frame poles without requiring that the sheet be wrapped around the frame poles as in the prior art. This provides a significant advantage of lessening the weight and providing better attachment of the support sheet to the frame poles.

The outer joints 25–28 each have a locking mechanism which give the frame poles rigidity when the stretcher is in use. Because the tubular members adjacent these joints fold in the weight-bearing direction, the weight on the stretcher will normally add the required rigidity. However, in transporting a patient over difficult terrain there may be a tendency for these joints to buckle upwardly, but the locking mechanism prevents this.

In accordance with the present invention, the locking mechanism in the outer joints is interconnected by linkages with the spreader bars 20, 21 and with the folding legs 36–39. The interconnecting linkage extends the folding legs and locks the outer joints when the spreader bars are extended. This interconnecting linkage is best shown in FIGS. 6–10.

Figure 9:
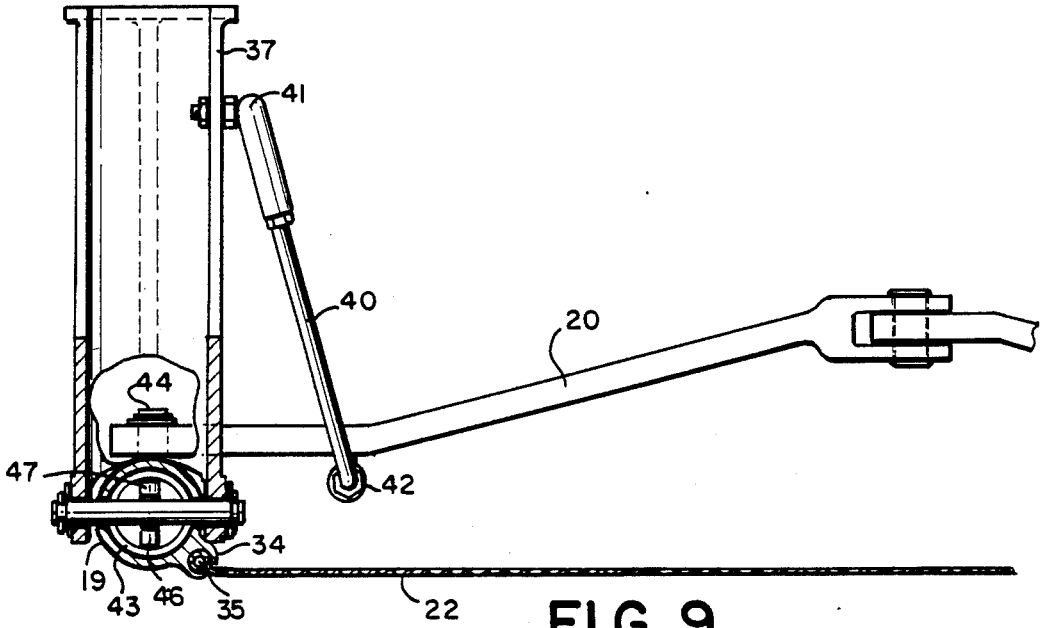
FIG. 9 is a view on the line 9—9 of FIG. 8.
Figure 10:
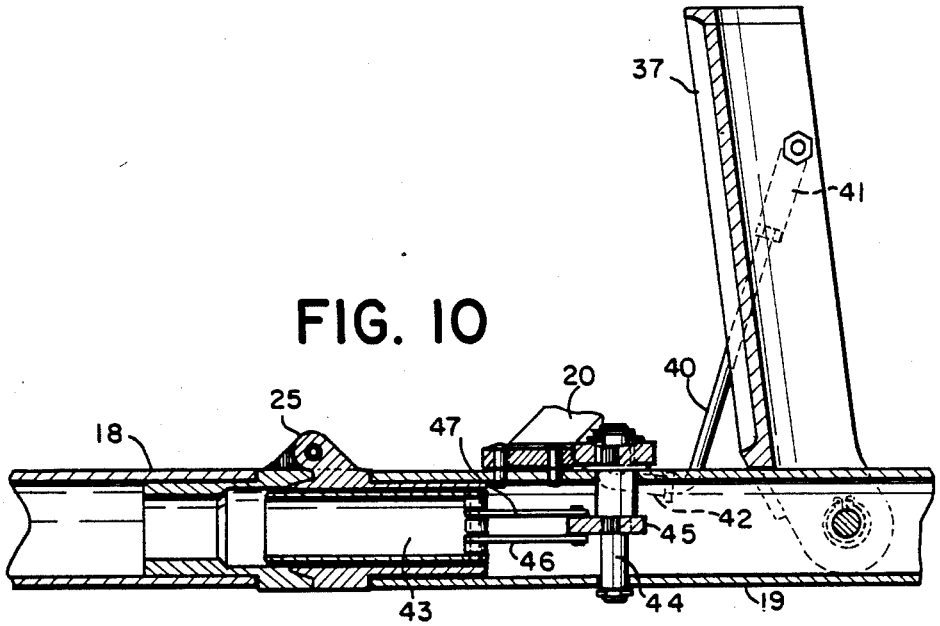
FIG. 10 is a view on the line 10—10 of FIG. 8.

Spreader bar 21 has an over-center mechanism so that when it is extended it will remain in this position until positively pushed into the folding position. Spreader bar 21 is connected by a link 40 to the folding leg 37. Link 40 is connected to the folding leg 37 at joint 41 (FIG. 9). Link 40 is connected to the spreader bar 21 at the joint 42. The movement of the spreader bar 21, folding leg 37, and link 40 in extending and collapsing the spreader bar, and in unfolding and folding the leg 37, can best be seen in FIG. 13 which depicts the three-dimensional movements of the joints 41 and 42. When the stretcher is extended, the joint 41 on the folding leg moves on the plane XZ from the point A to the point A′. In this movement, the joint 42 rotates on the plane XY from the point B to the point B′.

Referring back to FIGS. 6, 9 and 10, the locking mechanism includes a tube 43. Tube 43 is inside of the tubular member 12. Tube 43 spans tubular members 12 and 13 on both sides of outer joint 28 to lock it.

Spreader bar 21 rotates a pin 44 which in turn rotates an over-center link 45. Overcenter link 45 translates the rotational movement of the pin into longitudinal motion of links 46 and 47. This movement positions the tube 43 in the locking position when the spreader bars and legs are extended.

FIGS. 11 and 12 show the stretcher in its folded condition. The stretcher is extremely compact when folded, and can easily be carried on the back or in the hand of a bearer.

While a particular embodiment of the invention has been shown and described, various modifications of the invention are within the true spirit and scope of the invention. The appended claims are, therefore, intended to cover all such modifications.

What is claimed is:

1. A collapsible, portable stretcher comprising:

a pair of extendible frame poles;

a flexible support sheet secured to said frame poles and suspended from said poles when they are extended to form a weight-bearing platform;

each of said frame poles having a collapsible joint which is hinged to fold said frame poles;

a wedge insertable into said joint when said frame pole is extended so that said hinge supports said weight;

a spring biasing said wedge toward insertion into said joint when said frame pole is extended;

a frame, said wedge being mounted on said frame; and a U-shaped leg member, said frame being mounted for travel within said U-shaped leg member, said spring being mounted between said leg member and said frame to urge said wedge toward insertion into said joint.

2. The stretcher recited in claim 1 further comprising:

folding legs on both ends of each frame pole, said legs and said leg member forming a support for said stretcher.

3. The stretcher recited in claim 2 wherein said U-shaped leg member forms a carrying handle.

4. The stretcher recited in claim 1 further comprising:

folding legs on both ends of each frame pole;

spreader bars rigidly interconnecting said frame poles when said spreader bars are extended; and a link connecting said folding legs to one of said spreader bars so that said legs are moved away from said frame poles when said spreader bars are extended.

5. The stretcher recited in claim 1 wherein said joint is medial of said frame pole and wherein each of said frame poles further comprises:

a collapsible outer joint on each side of said medial joint and hinged to fold in the direction opposite to said medial joint so that said frame poles and said spreader bars can be collapsed into a compact package.

6. The stretcher recited in claim 5 wherein each of said outer joints has a locking mechanism for retaining the rigidity thereof when said frame poles are extended.

7. The stretcher recited in claim 6, wherein said frame poles include tubular members and wherein said locking mechanism for said outer joints includes a tube inside one of said tubular members and which is movable to span said tubular members on both sides of said outer joints to lock them.

8. The stretcher recited in claim 7 further comprising:

spreader bars rigidly interconnecting said frame poles when said spreader bars are extended; and a linkage which moves said tube into a position which locks said outer joint when said spreader bars are extended.

9. The stretcher recited in claim 8 wherein said linkage includes a pin rotated in one of said tubular members by a spreader bar, and a link connected to said pin and said tube to move said tube to span said tubular members as said pin rotates.

10. The stretcher recited in claims 4 or 8, wherein each of said spreader bars includes an over-center mechanism which locks when said spreader bars are extended.

11. The stretcher recited in claim 1 wherein each frame pole has a longitudinal closed channel having a longitudinal opening for receiving a bead on said support sheet to secure said support sheet to said frame poles.

12. A collapsible, portable, stretcher comprising:

a pair of extendible frame poles; each of said frame poles having a collapsible joint;

spreader bars rigidly interconnecting said frame poles when spreader bars are extended;

a flexible support sheet secured to said frame poles and suspended from said frame poles when they are extended to form a weight-bearing platform;

a locking mechanism for said collapsible joint for retaining the rigidity thereof when said frame poles are extended; and a linkage connecting said spreader bars to said locking mechanism so that said joint is locked when said spreader bars are extended.

13. The stretcher recited in claim 12 further comprising:

folding legs on both ends of said frame pole; and a linkage connecting said folding legs to one of said spreader bars so that said legs are moved away from said frame poles when said spreader bars are extended.

14. The stretcher recited in claim 12, wherein said frame poles include tubular members and wherein said locking mechanism includes a tube inside one of said tubular members and which is movable to span said tubular members on both sides of said joint to lock it.

15. The stretcher recited in claim 14 wherein said linkage includes a pin rotated in one of said tubular members by a spreader bar, and a link connected to said pin and said tube to move said tube to span said tubular members as said pin rotates.

16. The stretcher recited in claim 12 wherein each frame pole has a longitudinal closed channel having a longitudinal opening for receiving a bead on said support sheet to secure said support sheet to said frame poles.

17. The stretcher recited in claim 12, wherein each of said spreader bars includes an over-center mechanism which locks when said spreader bars are extended.

* * * * *